United States Patent [19]

Smith et al.

[11] 4,312,292

[45] Jan. 26, 1982

[54] SPRAY COATING APPARATUS HAVING A ROTATABLE WORKPIECE HOLDER

[75] Inventors: Marnell Smith; Victor W. Katvala, both of San Jose; Ernest E. Porter, Saratoga, all of Calif.

[73] Assignee: The United States of America as represented by the Administrator of the National Aeronautics and Space Administration, Washington, D.C.

[21] Appl. No.: 945,040

[22] Filed: Sep. 22, 1978

[51] Int. Cl.[3] ..... B05C 11/00; B05C 13/02

[52] U.S. Cl. ..... 118/320; 118/500; 118/503; 118/505; 427/425

[58] Field of Search ..... 118/500, 501, 502, 503, 118/504, 505, 320; 427/421, 425

[56] References Cited

U.S. PATENT DOCUMENTS

| | | | |
|---|---|---|---|
| 1,368,338 | 2/1921 | House | 118/500 |
| 1,544,120 | 6/1925 | Zickos et al. | 118/500 |
| 2,755,507 | 7/1956 | Heller | 118/416 X |
| 3,390,660 | 7/1968 | McDermott | 118/6 X |
| 3,420,210 | 1/1969 | Lindquist | 118/500 X |
| 3,583,363 | 6/1971 | Shrader | 118/500 X |
| 3,828,727 | 8/1974 | Bauerle | 118/500 |
| 3,912,249 | 10/1975 | Vaca | 118/500 X |
| 3,952,083 | 4/1976 | Fletcher et al. | 264/66 X |
| 4,023,524 | 5/1977 | Goldfarb et al. | 118/503 X |
| 4,068,792 | 1/1978 | Dixon | 118/505 X |

*Primary Examiner*—Shrive P. Beck

*Attorney, Agent, or Firm*—Darrell G. Brekke; John R. Manning

[57] ABSTRACT

A spray coating apparatus is provided for rotating a workpiece relative to a spray station to obtain a uniform coating of the workpiece. In a typical example, the workpiece comprises a ceramic tile which is to be coated with a ceramic coating and the tile is to be used as a reusable component of the thermal protection system for a space shuttle. The apparatus for rotating the workpiece includes a base support having a first rotatable stage for rotation in the horizontal plane and a second rotatable stage for rotation in a second plane inclined at an angle, such as 45 degrees, to the horizontal plane and the workpiece is supported on this second stage. Thus the workpiece is rotatable in both of two planes of rotation. The workpiece support is detachable from the first rotatable stage and the workpiece is readily detachable from the workpiece support to facilitate off loading of the spray coated workpiece. The workpiece holder includes a spray guard extending around the periphery of the workpiece to shield that surface of the workpiece where no coating is desired. The two degrees of freedom provided in the rotation of the workpiece relative to the spray station permits the various facets of the tile to be sequentially rotated into an orthogonal relationship to the spray station for uniform coating of the workpiece.

2 Claims, 3 Drawing Figures

SPRAY COATING APPARATUS HAVING A ROTATABLE WORKPIECE HOLDER

BACKGROUND OF THE INVENTION (1) Field of the Invention

The present invention relates, in general, to spray coating apparatus and more particularly to spray coating apparatus for rotating a workpiece relative to a spray station to obtain uniform spray coating of the workpiece.

This spray coating apparatus is designed for adaption to an automated spray station in an assembly line.

(2) Description of the Prior Art

Heretofore, spray coating devices have been proposed for spray coating of workpieces, such as shoes, wherein the workpiece was mounted for rotation in the horizontal plane about a vertical axis relative to a spray station so as to coat the workpiece uniformly on all sides facing the spray station. Such a spray coating apparatus is disclosed in U.S. Pat. No. 3,390,660 issued July 2, 1968.

It is also known from the prior art to place a reusable surface insulation tile on a fixed pedestal and to spray the tile by moving the spray gun relative to the stationary horizontal tile. Alternatively, it is known from the prior art to mount the tile to a model holding device and, while holding the tile on the model holding device in one hand, spraying the tile with the other hand. Reusable surface insulation tiles are disclosed in U.S. Pat. No. 3,952,083 issued Apr. 20, 1976.

A ¼" strip along the bottom of each vertical side edge of the tile must be coating free. Therefore, masking tape was applied to that area before spraying. This masking tape was removed after the coating was dried but before the coating was glazed.

In the prior art method wherein the tile rested in the horizontal plane on the pedestal for spray coating, the sides of the tile were vertical and the top of the tile was horizontal. A uniform coating of a specified thickness was difficult to achieve with this arrangement because the coating slurries were of relatively low viscosity and often ran on the tile's vertical sides while the coating deposited on the top of the tile was much thicker than on its sides.

When a hand-held holder was employed, it was cumbersome to use and increased the possibility of handling damage to the coating. Neither of the prior art methods were amenable to large scale manufacturing of reusable insulation tile. In addition, the use of the masking tape to obtain an uncoated border along the bottom of the vertical sides of the tile was time consuming and when the masking tape was removed, the unfired coating was often damaged.

SUMMARY OF THE PRESENT INVENTION

The principal object of the present invention is the provision of an improved spray coating apparatus for spray coating of a workpiece and particularly suitable for spray coating of reusable thermal insulation tiles.

In one feature of the present invention, the workpiece is mounted on a rotatable stage which is inclined at a substantial angle to the horizontal. This rotatable stage is mounted on another rotatable stage which rotates in the horizontal plane. Thus, the workpiece can be rotated in two degrees of rotation, whereby the facets of the workpiece may be sequentially rotated into orthogonal relation to the spray station to obtain a uniform coating of the workpiece.

In another feature of the present invention, the workpiece support structure includes a first detachable workpiece holder which is detachable from the first rotatable stage of the spray coating apparatus to facilitate handling of the coated workpiece.

In another feature of the present invention, this invention is designed to be incorporated into an automatic spray station in an assembly line.

in another feature of the present invention, the workpiece holder includes upstanding lip portions for shielding the sides of the workpiece to prevent coating thereof in certain regions.

In another feature of the present invention, the detachable workpiece holder includes a central aperture therein to facilitate removal of the workpiece from the workpiece holder.

Other features and advantages of the present invention will become apparent upon a perusal of the following specification taken in connection with the accompanying drawings wherein:

DESCRIPTION OF THE PREFERRED EMBODIMENTS

Figure 1:
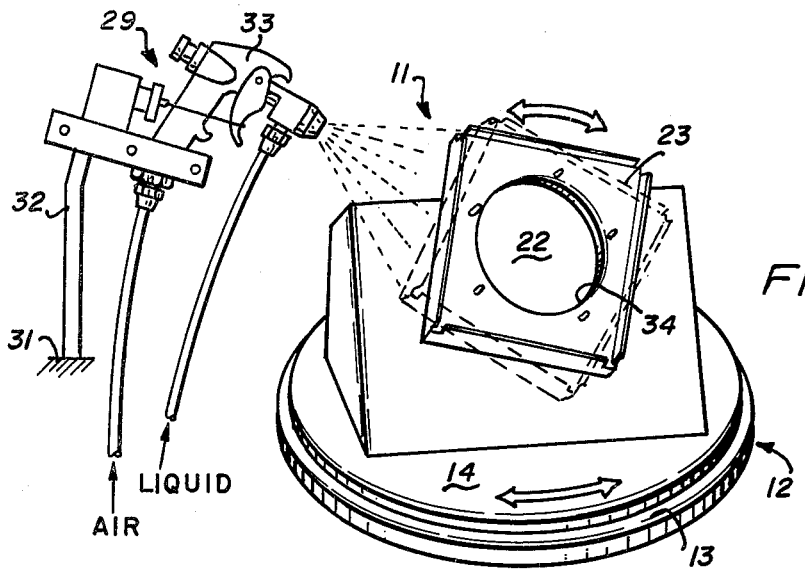
FIG. 1 is a perspective view of a spray coating apparatus incorporating features of the present invention.
Figure 2:
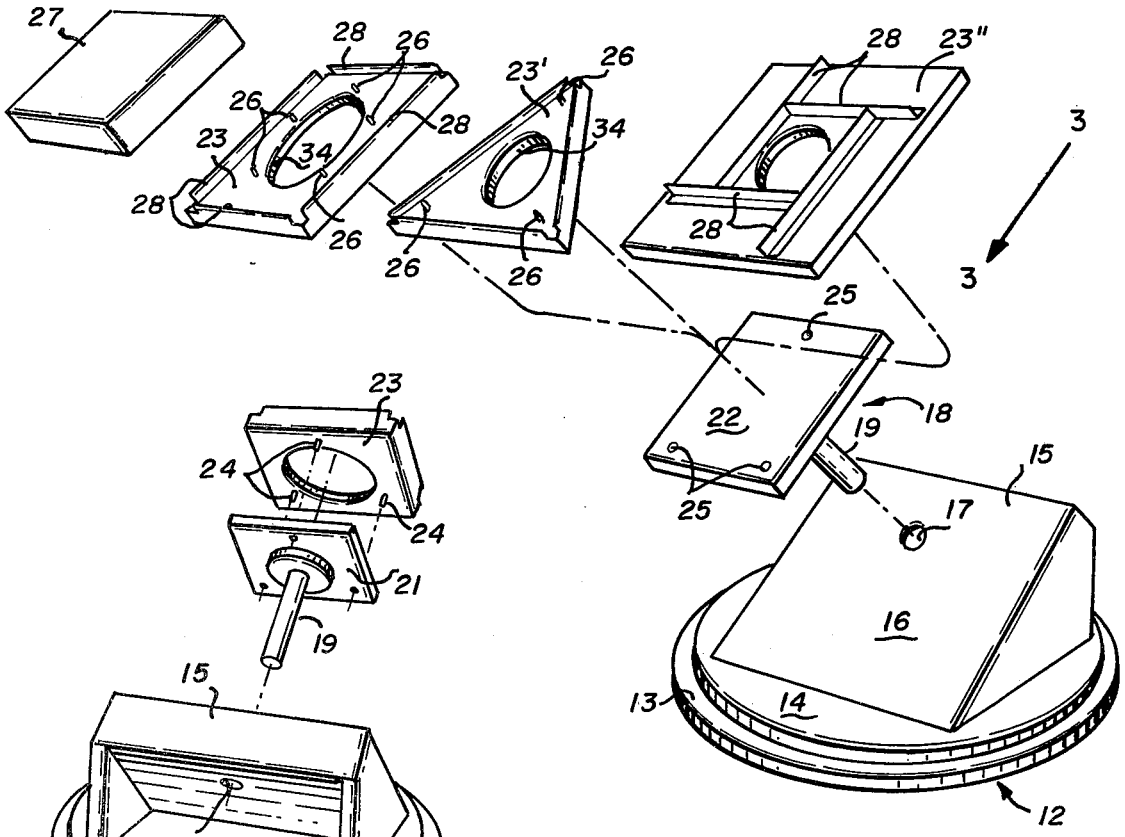
FIG. 2 is a view depicting the workpiece holder portion in exploded view and depicting alternative workpiece holder configurations.
Figure 3:
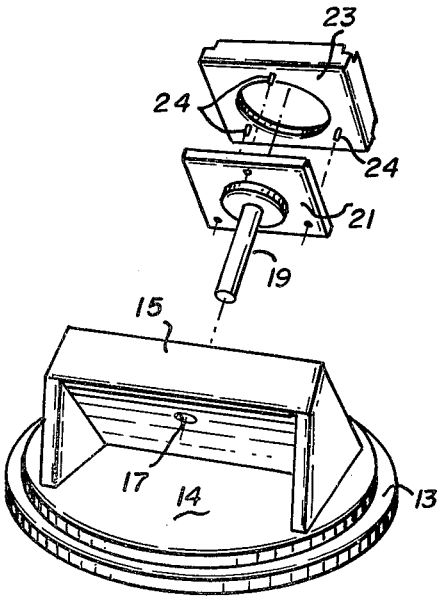
FIG. 3 is a perspective view of the structure of FIG. 2 taken in the direction of the arrow 3—3.

Referring now to FIGS. 1–3, there is shown a spray coating apparatus 11 incorporating features of the present invention. The spray coating apparatus 11 includes a base support structure 12, such as a table, for providing support from a horizontal reference plane via the intermediary of a stationary base plate 13. A turntable 14 is rotatably coupled to and supported from the base plate 13 via a conventional vertical axle and ball bearing assembly, not shown, vertically dependent from the turntable 14 and centrally disposed of the turntable. A 45 degree table 15 is fixedly secured to the turntable 14 via the intermediary of screws, not shown. The 45 degree table 15 includes a major face portion 16 inclined at 45 degrees to the horizontal plane and includes a cylindrical bore 17 axially aligned with the normal to the 45 degree inclined face 16.

A second turntable 18 includes a dependent axle 19 which is received within the cylindrical bore 17 through the major face of the 45 degree table 15 for rotation therein. The second turntable 18 includes a table portion 21 affixed to the axle 19 and having a major face 22 which is inclined at 45 degrees to the horizontal.

A detachable workpiece holder 23 is detachable coupled to the second turntable portion 21 via the intermediary of a plurality of dowels 24 depending from the workpiece holder 23 and loosely fitting within aligned bores 25 in the face 22 of the second turntable portion 21.

The workpiece holder 23 can take any one of a number of different configurations as depicted in FIG. 2 at 23, 23' and 23''. In the holder embodiments 23 and 23', the upper face of the workpiece holder includes a plurality of upstanding pins 26 for insertion into the back face of the workpiece to be coated, such as a reusable thermal insulation tile 27. A spray guard lip 28 extends upwardly from the upper face of the workpiece holder 23 for shielding the lower portions of the side edges of the tile workpiece 27 from sprayed coating material.

A spray coating station 29 is mounted to the reference base support, such as a table 31, via the intermediary of a bracket 32 which serves to clamp a spray gun 33 in position so that the spray from the spray gun is directed at the workpiece 27 in the desired direction, i.e., normal to the face of the workpiece 27 being spray coated.

Thus, in the preferred embodiment for spraying rectangular tile 27, the central axis of the spray cone or fan is directed at 45 degrees to the horizontal plane when the tile 27 is rotated in a plane at 45 degrees to the horizontal. In this manner, the sprya is directed orthogonally onto the surface being coated. The two turntable stages 14 and 21 permit successive facets of the rectangular workpiece to be sequentially rotated into spraying position relative to the spray station 29 so that the surface being coated is perpendicular to the central ray of the spray cone emitted from the spray station 29.

Once the workpiece 27 has been sprayed, the workpiece holder 23 is detached from the second turntable stage 21 and the holder 23, as held in the horizontal plane, is lowered onto a pedestal which passes up through a central aperture 34 in the workpiece holder, thereby separating the coated workpiece from the holder so that the next workpiece can be inserted into the holder 27 and the process repeated.

In a typical example, a 6" by 6" by 2" reusable surface insulation tile 27 is placed on the workpiece holder 23. The tile 27 is held in place by ¼" long pins 26. The spray guard or lip 28 is approximately ¼ of an inch high and is spaced away from the side edges of the tile 27 by 1/16 inch. The workpiece holder 23, with the tile in place, is then set on the second turntable stage 21. The tile is then ready to be coated. Reaction cured glass coating for the space shuttle thermal protection is applied as a low viscosity slurry that is uniformly sprayed onto the tile 27. A Binks model #69 spray gun with a type #66 nozzle is used to spray the tiles. The spray gun 33 is held perpendicular to the surface being coated and at about 6" to 8" away from the surface. The tile's sides are coated by moving the second turntable stage 21 so that each side surface faces the spray station 29 sequentially. The top surface is then moved to face the sprayer by rotating the first turntable stage 14. This procedure is repeated until the proper thickness of coating has been applied to the tile 27. Approximately 0.0012" to 0.0015" of coating is applied per pass. After coating, the tile 27 and tile holder 23 are removed from the second stage 21. The tile is removed from the workpiece holder 23 by setting the tile 27 on a round pedestal projecting up through the center aperture 34 and lowering the tile holder away from the coated tile. This procedure takes less than 10 minutes per tile.

The advantage in using the spray coating apparatus of the present invention is that it allows resuable surface insulation tile substrate to be coated with no masking and demasking, no handling of the wet coating, and gives a repeatable, uniformly thick coating. The spray coating apparatus makes automation of the coating process feasible. Use of the spray coating device for coating reusable surface insulation tile requires less time to coat each tile, lowers the scrapage rate, and the coating process requires fewer and less skilled personnel.

As an alternative to employing dowels 24 and pins 26 for holding the workpiece holder 23 to the second turntable 21, and for holding the workpiece 27 to the holder 23, the holder 23 with flat workpiece 27 in place over the central aperture 34, may be held to the turntable by vacuum. This is accomplished by boring a cylindrical hole through the turntable 21 and axle 19 in axial alignment therewith and coupling the bore in gas communication with a vacuum pump via the intermediary of a rotatable vacuum joint, not shown. Rotatable vacuum joints are commercially available from The Johnson Corporation of Three Rivers, Michigan as model #3100W "Free Wheeler".

What is claimed is:

1. In a spray coating apparatus for rotating a tile relative to a spray station to obtain a uniform coating of the tile on its front face and side surfaces:

a base plate for disposition on a horizontal reference support plane;

a first turntable supported by and parallel to said base plate and free to rotate in a horizontal plane about a vertical axis of rotation;

a table secured to said first turntable, said table having a major face portion inclined to the horizontal plane;

a second turntable rotatably coupled to said major face portion and free to rotate in a plane parallel to said major face portion about an axis of rotation normal to said major face portion; said second turntable having a number of bores each with a longitudinal axis parallel to said second turntable axis of rotation;

a detachable tile holder adapted to be supported by said second turntable, said tile holder comprising; a plate with first and second opposite faces, said first plate face adapted to support the back face of the tile to be coated, a plurality of erect pins secured to said first plate face and adapted to impale the back face of the tile to be coated, a guard lip extending upwardly from said first face of said plate for shielding the lower portions of the side walls of the tile to be coated, a plurality of dowels secured normal to said second plate face, said dowels being slightly smaller than said second turntable bores and disposed in alignment with said bores so that said dowels may rest within said bores, and said plate having an aperture to receive a pedestal for separating a coated tile from said detachable tile holder.

2. In a spray coating apparatus for uniformly coating the front face and side surfaces of a tile:

a base plate for disposition on a horizontal reference support plane;

a first turntable supported by and parallel to said base plate and free to rotate in a horizontal plane about a vertical axis of rotation;

a table secured to said first turntable, said table having a major face portion inclined to the horizontal plane;

a second turntable rotatably coupled to said major face portion and free to rotate in a plane parallel to said major face portion about an axis of rotation normal to said major face portion; said second turntable having a number of bores each with a longitudinal axis parallel to said second turntable axis of rotation;

a detachable tile holder adapted to be supported by said second turntable, said tile holder comprising; a plate with first and second opposite faces, said first plate face adapted to support the back face of the tile to be coated, a plurality of erect pins secured to said first plate face and adapted to impale the back face of the tile to be coated, a guard lip extending upwardly from said first face of said plate for shielding the lower portions of the side walls of the tile to be coated, a plurality of dowels secured normal to said second plate face, said dowels being slightly smaller than said second turntable bores and disposed in alignment with said bores so that said dowels may rest within said bores, and said plate having an aperture to receive a pedestal for separating a coated tile from said detachable tile holder; and a spray gun mounted in proximity to said tile holder for spraying a tile in said tile holder, said spray gun having a spray axis that lies on the cone of revolution made by the axis of rotation of the second turntable when the first turntable is revolved whereby said spray axis is normal to the front face of a tile in said holder when said first turntable is rotated until the front face of the tile is directly facing said spray gun.

* * * * *